US009737187B2

(12) United States Patent
Bantum

(10) Patent No.: US 9,737,187 B2
(45) Date of Patent: Aug. 22, 2017

(54) EXTRACTOR CLEANING MACHINE

(71) Applicant: Techtronic Floor Care Technology Limited, Tortola (VG)

(72) Inventor: John Bantum, Munroe Falls, OH (US)

(73) Assignee: Techtronic Floor Care Technology Limited, Tortola (VG)

( * ) Notice: Subject to any disclaimer, the term of this patent is extended or adjusted under 35 U.S.C. 154(b) by 792 days.

(21) Appl. No.: 14/172,063

(22) Filed: Feb. 4, 2014

(65) Prior Publication Data

US 2015/0216385 A1 Aug. 6, 2015

(51) Int. Cl.

| | |
|---|---|
| ***A47L 7/00*** | (2006.01) |
| ***A47L 11/34*** | (2006.01) |
| ***A47L 11/40*** | (2006.01) |
| ***A47L 9/28*** | (2006.01) |
| *A47L 11/30* | (2006.01) |

(52) U.S. Cl.

CPC ..... *A47L 11/34* (2013.01); *A47L 7/0009* (2013.01); *A47L 7/0023* (2013.01); *A47L 9/2863* (2013.01); *A47L 11/4069* (2013.01); *A47L 11/4083* (2013.01); *A47L 11/4088* (2013.01); *A47L 11/30* (2013.01)

(58) Field of Classification Search

CPC .. A47L 11/00; A47L 11/34; A47L 7/00; A47L 11/4088

USPC ..... 15/320, 321, 319

See application file for complete search history.

(56) References Cited

U.S. PATENT DOCUMENTS

| | | | | |
|---|---|---|---|---|
| 1,687,283 | A | 10/1928 | Deutscher | |
| 3,451,495 | A | 6/1969 | Bayless et al. | |
| 4,766,640 | A | 8/1988 | Martin et al. | |
| 5,189,755 | A * | 3/1993 | Yonkers | A47L 11/4083 15/321 |

(Continued)

FOREIGN PATENT DOCUMENTS

| | | |
|---|---|---|
| EP | 2567649 | 3/2013 |
| GB | 2334668 | 9/1999 |
| GB | 2458220 | 9/2009 |

OTHER PUBLICATIONS

Invitation to Pay Additional Fee for Application No. PCT/US2015/013800 dated May 8, 2015 (6 pages).

(Continued)

*Primary Examiner* — Michael Jennings

(74) *Attorney, Agent, or Firm* — Michael Best & Friedrich LLP

(57) ABSTRACT

An extractor includes a base movable along a surface having an agitator. The extractor also includes a distribution nozzle, a suction nozzle, and a suction source in fluid communication with the suction nozzle and operable to draw fluid and dirt from the surface, a recovery tank in fluid communication with the suction source to receive and store the fluid and dirt drawn, a supply tank supported by the base and in fluid communication with the distribution nozzle to supply cleaning fluid, a pump in fluid communication with the supply tank and the distribution nozzle to deliver fluid from the supply tank to the distribution nozzle, a motor operable to drive the agitator and the pump, and a drive mechanism coupled to the motor, the agitator, and the pump and operable to selectively connect the agitator and the pump to the motor to alternately drive the agitator and the pump.

21 Claims, 10 Drawing Sheets

(56) References Cited

U.S. PATENT DOCUMENTS 5,297,312 A 3/1994 Zuiderveen et al.
5,537,712 A 7/1996 Weber et al.
5,761,763 A * 6/1998 McAllise ..... A47L 7/0009 15/320
5,887,313 A 3/1999 Hanold et al.
5,983,442 A 11/1999 Louis et al.
6,073,300 A * 6/2000 Zahuranec ..... A47L 11/4016 15/320
6,131,238 A 10/2000 Weber et al.
6,145,145 A 11/2000 Besel
6,167,587 B1 * 1/2001 Kasper ..... A47L 5/30 15/320
6,438,793 B1 8/2002 Miner et al.
6,446,302 B1 * 9/2002 Kasper ..... A47L 11/30 15/319
6,513,188 B2 * 2/2003 Zahuranec ..... A47L 5/225 15/320
6,533,871 B2 * 3/2003 Zahuranec ..... A47L 5/32 134/21
6,536,071 B2 * 3/2003 Zahuranec ..... A47L 7/0009 15/320
6,915,544 B2 7/2005 Roney et al.
7,062,816 B2 6/2006 Kasper et al.
7,861,369 B2 1/2011 Miner et al.
7,877,836 B2 * 2/2011 O'Neal ..... A47L 5/225 15/319
7,954,200 B2 * 6/2011 Leonatti ..... A47L 11/34 15/320
8,186,009 B2 5/2012 Smith et al.
8,336,162 B2 12/2012 Dever
8,370,991 B2 * 2/2013 Paliobeis ..... A47L 11/4083 15/320
8,635,740 B2 * 1/2014 Gordon ..... A47L 11/34 15/320
2001/0039684 A1 * 11/2001 Kasper ..... A47L 5/30 8/147
2004/0216265 A1 * 11/2004 Peacock ..... A47L 5/30 15/384
2005/0283936 A1 * 12/2005 Barker ..... A47L 11/4091 15/320
2006/0075596 A1 * 4/2006 Bosses ..... A47L 9/0411 15/320
2007/0056137 A1 * 3/2007 Miner ..... A47L 5/30 15/390
2007/0234503 A1 * 10/2007 Krebs ..... A47L 9/0036 15/331
2008/0047093 A1 * 2/2008 Gordon ..... A47L 11/34 15/320
2008/0134463 A1 * 6/2008 Choi ..... A47L 11/4041 15/390
2008/0271285 A1 11/2008 Maurer et al.
2009/0089958 A1 4/2009 Dant et al.
2009/0123293 A1 5/2009 Gierer et al.
2009/0276975 A1 11/2009 Vines
2010/0017999 A1 1/2010 Bassett
2011/0078874 A1 * 4/2011 Dever ..... A47L 5/30 15/390
2011/0079248 A1 * 4/2011 Huffman ..... A47L 11/34 134/21
2012/0047678 A1 * 3/2012 Gordon ..... A47L 11/34 15/322
2012/0222235 A1 * 9/2012 Lenkiewicz ..... A47L 11/34 15/322
2012/0304416 A1 * 12/2012 Nguyen ..... A47L 11/34 15/383

OTHER PUBLICATIONS

International Search Report and Written Opinion for Application No. PCT/US2015/013800 dated Jul. 17, 2015 (17 pages).
Australian Examination Report No. 1 for Application No. 2015214510 dated May 1, 2017 (5 pages).

* cited by examiner

EXTRACTOR CLEANING MACHINE

BACKGROUND

The present invention relates to extractor cleaning machines and, more particularly, to extractor cleaning machines including drive mechanisms for selectively driving multiple components from one motor.

Typically, extractor cleaning machines include one or more components that are driven by one or more motors. For example, extractor cleaning machines may include an agitator brush, a pump, a suction fan, and, in even some cases, wheels that are driven by motors. The agitator brush is used to scrub the surface being cleaned. The suction fan generates a vacuum force that draws in dirt from the surface being cleaned. The wheels facilitate movement of the extractor cleaning machine across the surface. Many extractor machines also include accessory tools to facilitate cleaning of surfaces other than floor surfaces. These accessory tools are used for above-the-floor cleaning. For example, the accessory tools may be used for cleaning drapes, steps, and the like. The accessory tools sometimes also distribute cleaning fluid using pumps.

SUMMARY

In one embodiment, the invention provides an extractor cleaning machine including a base that is movable along a surface to be cleaned. The base includes an agitator. The extractor cleaning machine also includes a distribution nozzle, a suction nozzle, and a suction source in fluid communication with the suction nozzle. The suction source is operable to draw fluid and dirt from the surface through the suction nozzle. The extractor cleaning machine further includes a recovery tank supported by the base. The recovery tank is in fluid communication with the suction source to receive and store the fluid and dirt drawn through the suction nozzle. The extractor cleaning machine also includes a supply tank supported by the base. The supply tank is in fluid communication with the distribution nozzle to supply cleaning fluid to the distribution nozzle. The extractor cleaning machine further includes a pump in fluid communication with the supply tank and the distribution nozzle to deliver fluid from the supply tank to the distribution nozzle. The extractor cleaning machine also includes a motor operable to drive the agitator and the pump. The motor includes an output shaft. The extractor cleaning machine also includes a drive mechanism coupled to the output shaft of the motor, the agitator, and the pump. The drive mechanism is operable to selectively connect the agitator and the pump to the motor to alternately drive the agitator and the pump.

In another embodiment, the invention provides an extractor cleaning machine including a base that is movable along a surface to be cleaned. The base includes a suction nozzle. The extractor cleaning machine also includes an accessory tool coupled to the base for above-the-floor cleaning. The accessory tool includes a distribution nozzle. The extractor cleaning machine further includes a handle pivotally coupled to the base for movement between a substantially upright position and an inclined operating position, and a suction source in fluid communication with the suction nozzle. The suction source is operable to draw fluid and dirt from the surface through the suction nozzle. The extractor cleaning machine also includes a recovery tank supported by the base. The recovery tank is in fluid communication with the suction source to receive and store the fluid and dirt drawn through the suction nozzle. The extractor cleaning machine further includes a supply tank supported by the base. The supply tank is in fluid communication with the distribution nozzle to supply cleaning fluid to the distribution nozzle. The extractor cleaning machine also includes a pump in fluid communication with the supply tank and the distribution nozzle to deliver fluid from the supply tank to the distribution nozzle. The extractor cleaning machine further includes a motor operable to drive the pump. The motor includes an output shaft. The extractor cleaning machine also includes a belt coupled to the output shaft of the motor and the pump to selectively drive the pump, and a belt tensioner movable relative to the belt. The belt tensioner engages the belt to tension the belt when the handle is in the substantially upright position, and disengages the belt to untension the belt when the handle is in the inclined operating position.

In yet another embodiment, the invention provides a drive mechanism for selectively driving a first component and a second component of an extractor cleaning machine. The extractor cleaning machine includes a motor having an output shaft. The drive mechanism includes a first drive member connecting the first component to the output shaft of the motor. The drive mechanism also includes a second drive member connecting the second component to the output shaft of the motor. The drive mechanism further includes an actuating device movable relative to the first and second drive members to selectively engage the first and second drive members and alternately drive the first component and the second component.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
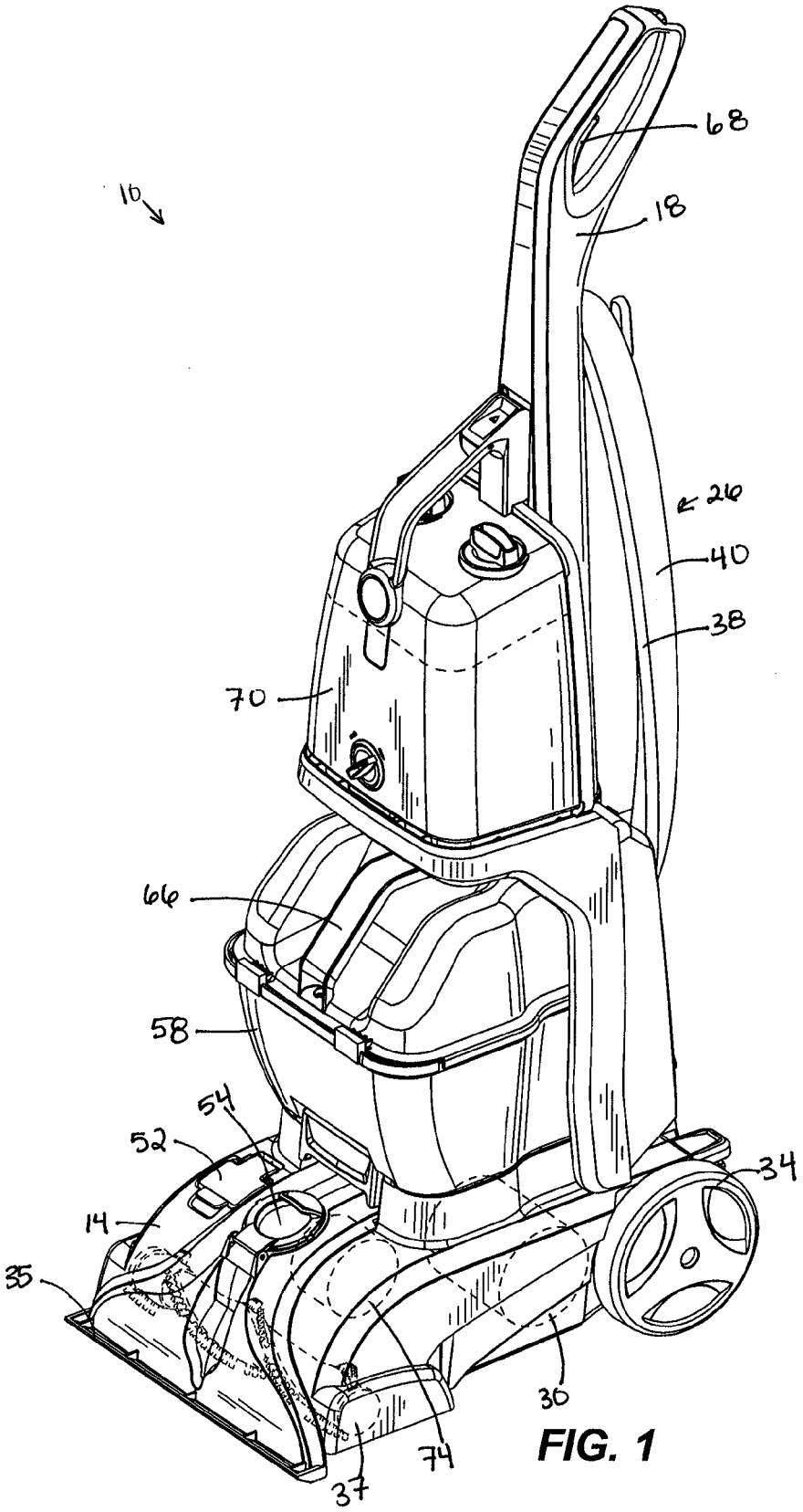
FIG. 1 is a perspective view of an extractor cleaning machine, the extractor cleaning machine including a handle in an upright position.

FIG. 1 illustrates an extractor cleaning machine 10. The illustrated extractor cleaning machine 10 (herein after referred to simply as an "extractor") is an upright extractor operable to clean a surface such as, for example, a floor. In some embodiments, the extractor may be operable to clean a variety of surfaces, such as carpets, hardwood floors, tiles, or the like. The extractor 10 distributes a cleaning fluid, for example, water, detergent, or a mixture of water and detergent, onto the surface to clean the surface. The extractor 10 then draws the cleaning fluid and dirt off of the surface, leaving the surface relatively clean and dry.

In the illustrated embodiment, the extractor 10 includes a base 14, a handle 18 coupled to the base 14, an accessory tool 26 for above-the-floor cleaning, a motor 30, a suction system, and a fluid distribution system. The base 14 supports the other components of the extractor 10 and includes two wheels 34 (only one of which is shown in FIG. 1) to facilitate movement of the extractor 10 along the surface. In the illustrated embodiment, the wheels 34 are idle wheels. In other embodiments, the wheels 34 may be driven wheels.

The base 14 also includes a suction nozzle 35, a distribution nozzle 36 (FIG. 2), and an agitator 37. The suction nozzle 35 is part of the suction system and is positioned near a lower surface of the base 14. The suction nozzle 35 draws dirt, fluid, and other objects into the extractor 10 to clean a surface. The distribution nozzle 36 is part of the fluid distribution system and is adjacent the suction nozzle 35. The distribution nozzle 36 distributes cleaning fluid to a surface to be cleaned. The illustrated agitator 37 is a horizontal brush roll supported on the base 14 adjacent the suction nozzle 35 and the distribution nozzle 36. The agitator 37 is driven by the motor 30 to rotate relative to the base 14. In the illustrated embodiment, the agitator 37 includes bristles and/or beater bars to help scrub, beat, and otherwise clean a surface. In other embodiments, other suitable agitators may also or alternatively be employed.

Figure 2:
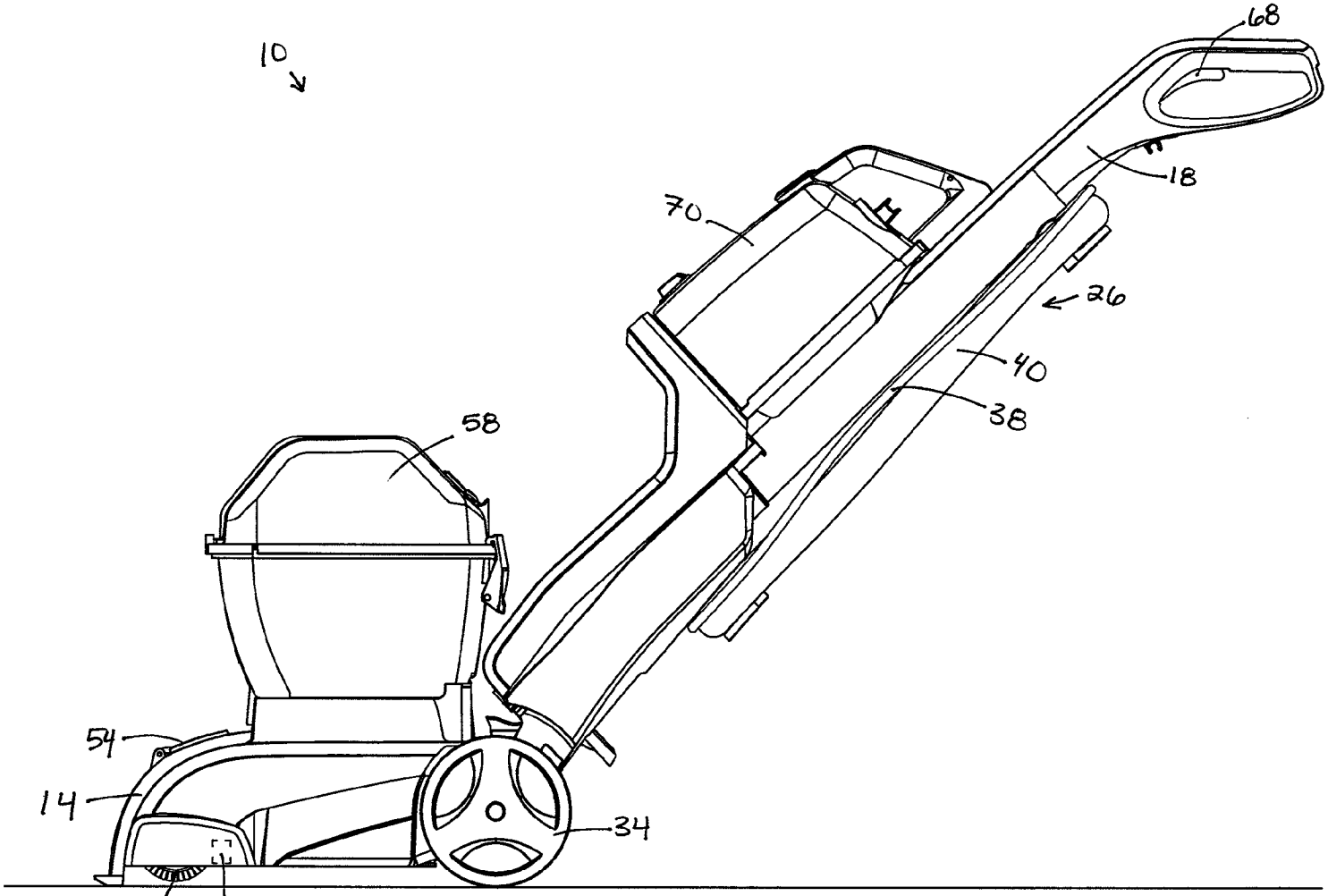
FIG. 2 is a side view of the extractor cleaning machine with the handle in an inclined operating position.

The handle 18 is pivotally coupled to and extends from the base 14. The handle 18 is movable between an upright position (FIG. 1) and an inclined position (FIG. 2). When in the upright position (FIG. 1), the handle 18 facilitates storage of the extractor 10. When in the inclined position (FIG. 2), the handle 18 facilitates moving the base 14 along the surface to be cleaned.

Figure 3:
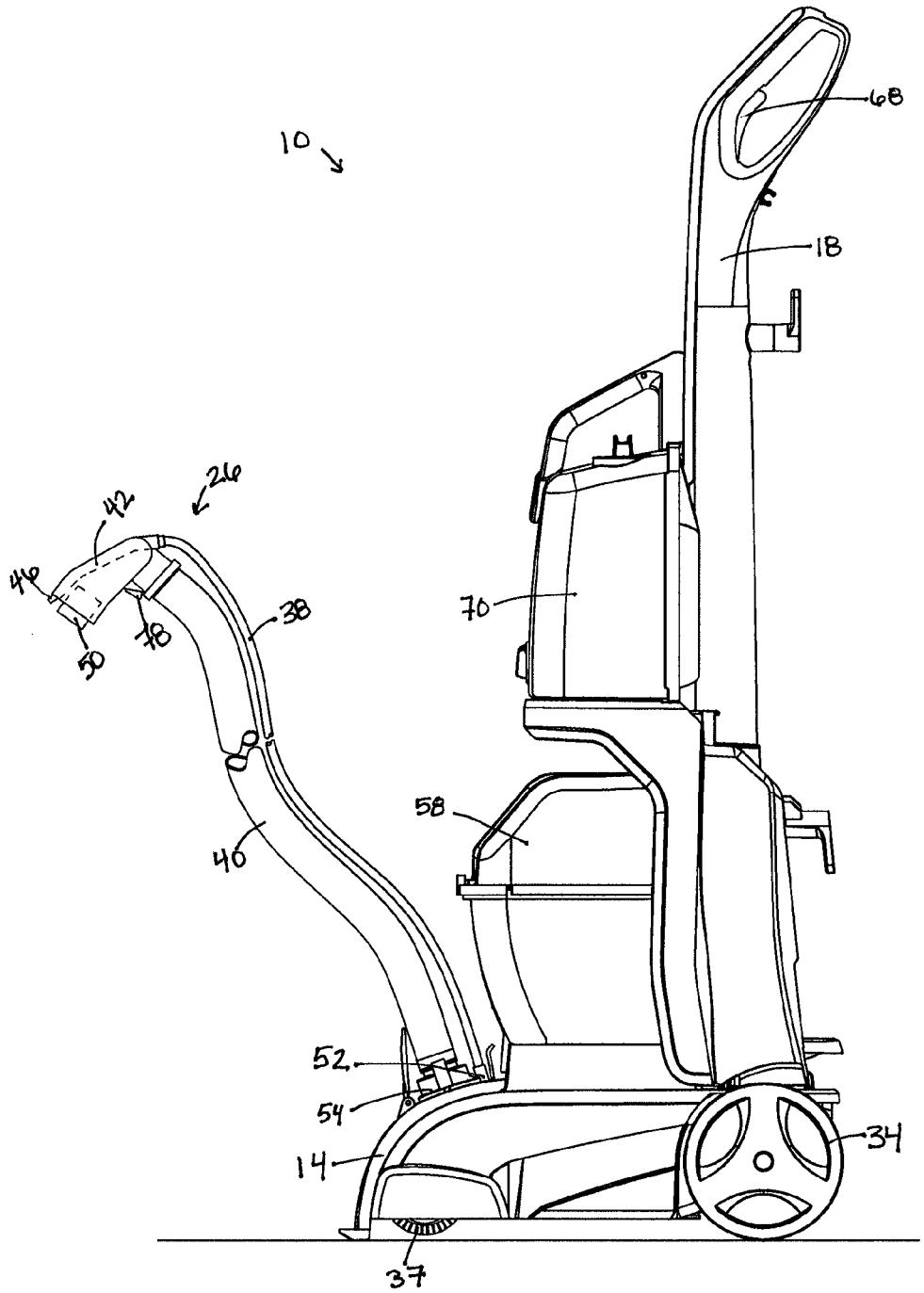
FIG. 3 is a side view of the extractor cleaning machine with the handle in the upright position and an accessory tool in an operating position.

As shown in FIG. 3, the accessory tool 26 is usable for above-the-floor cleaning when the handle 18 is in the upright position. In the illustrated embodiment, the accessory tool 26 includes a first hose 38, a second hose 40, and a cleaning head 42. The cleaning head 42 includes a distribution nozzle 46 and a suction nozzle 50. In some embodiments, the cleaning head 42 may also include a powered or non-powered agitator to help scrub or otherwise clean a surface. In some embodiments, the cleaning head 42 is removable from the accessory tool 26 and different cleaning heads can be used to perform above-the-floor cleaning of, for example, furniture, drapes, steps, and the like.

The first hose 38, or conduit, connects to a first connection port 52 on the base 14. The first connection port 52 is in communication with the fluid distribution system to deliver cleaning solution to the distribution nozzle 46 of the cleaning head 42 through the first hose 38. The second hose 40, or conduit, connects to a second connection port 54 on the base 14. The second connection port 54 is in communication with the suction system via the suction nozzle 50 to generate a suction force at the suction nozzle 50 of the cleaning head 42. In some embodiments, the first hose 38 and the second hose 40 are joined together with a sleeve that encloses both the first hose 38 and the second hose 40. In other embodiments, the first hose 38 and the second hose 40 are joined together in another suitable manner. For example, the first hose 38 and the second hose 40 may be joined together with fasteners along the length of the first hose 38 and the second hose 40. When the accessory tool 26 is not in use, the accessory tool 26 can be stowed in a storage position adjacent a rear surface of the handle 18, as shown in FIG. 1.

The suction system includes a floor surface suction subsystem and an accessory tool suction subsystem. The floor surface suction subsystem includes a suction fan, a recovery tank 58, and the suction nozzle 35 coupled to the base 14. In the illustrated embodiment, the suction fan is supported in the base 18 generally beneath the recovery tank 58. In other embodiments, the suction fan may be positioned elsewhere on the extractor 10. The suction fan is mounted to and directly driven by the motor 30. The suction fan is in fluid communication with the suction nozzle 35 coupled to the base 14 and generates a vacuum to draw fluid and dirt from a surface through the suction nozzle 35 coupled to the base 14 and propel the fluid and dirt into the recovery tank 58.

In the illustrated embodiment, the recovery tank 58 is coupled directly to and supported by the base 14. In other embodiments, the recovery tank 58 may be coupled directly to the handle 18, which is supported by the base 14. The recovery tank 58 receives fluid and dirt drawn in from the surface through the suction nozzle 35 coupled to the base. In some embodiments, the recovery tank 58 is removable from the extractor 10. In the illustrated embodiment, the recovery tank 58 includes a handle 66 to facilitate carrying the recovery tank 58 apart from the base 14. The recovery tank 58 may also include one or more user-operable latches, magnets, or other connector mechanisms to releasably secure the recovery tank 58 to the extractor 10.

The accessory tool suction subsystem includes the suction fan, the recovery tank 58, the suction nozzle 50 on the accessory tool 26, and the second hose 40 connected to the suction nozzle 50. The second hose 40 is a suction hose of the accessory tool 26. The suction hose 40 is in fluid communication with the suction fan and the suction nozzle 50 of the accessory tool 26 to draw fluid and dirt from a surface to be cleaned. As previously described, the suction fan generates a vacuum to draw fluid, dirt, and other objects through the suction nozzle 50 on the accessory tool 26. The recovery tank 58 receives any fluid and dirt drawn in by the suction nozzle 50 of the accessory tool 26.

The fluid distribution system is supported by the base 14 and includes a gravity fluid distribution subsystem and an accessory tool distribution subsystem. The gravity fluid distribution subsystem includes a supply tank 70, the distribution nozzle 36 located on the base 14, a trigger 68, and conduits that connect the supply tank 70 to the distribution nozzle 36 of the base 14. In the illustrated embodiment, the supply tank 70 is coupled to the handle 18 and supported by the base 14. In other embodiments, the supply tank 70 may be directly coupled to and supported by the base 14. The supply tank 70 is in fluid communication with the distribution nozzle 36 coupled to the base 14 to distribute cleaning fluid to the surface to be cleaned. The trigger 68 is positioned on the handle 18 and actuatable to spray or distribute cleaning fluid through the distribution nozzle 36 onto the surface. The conduits include a valve coupled to the trigger 68 that may be selectively opened by actuating the trigger 68. The valve allows fluid to flow out of the supply tank 70. Gravity draws the cleaning fluid downward to be expelled through the distribution nozzle 36 coupled to the base 14. In some embodiments, the supply tank 70 provides two separate cleaning fluids (e.g., water and detergent) to the distribution nozzle 36. The gravity fluid distribution subsystem then mixes the fluids and distributes the mixed cleaning fluid onto the surface through the distribution nozzle 36 coupled to the base 14. In some embodiments, the gravity fluid distribution subsystem may alternatively include a pump to draw cleaning fluid from the supply tank 70.

Figure 4:
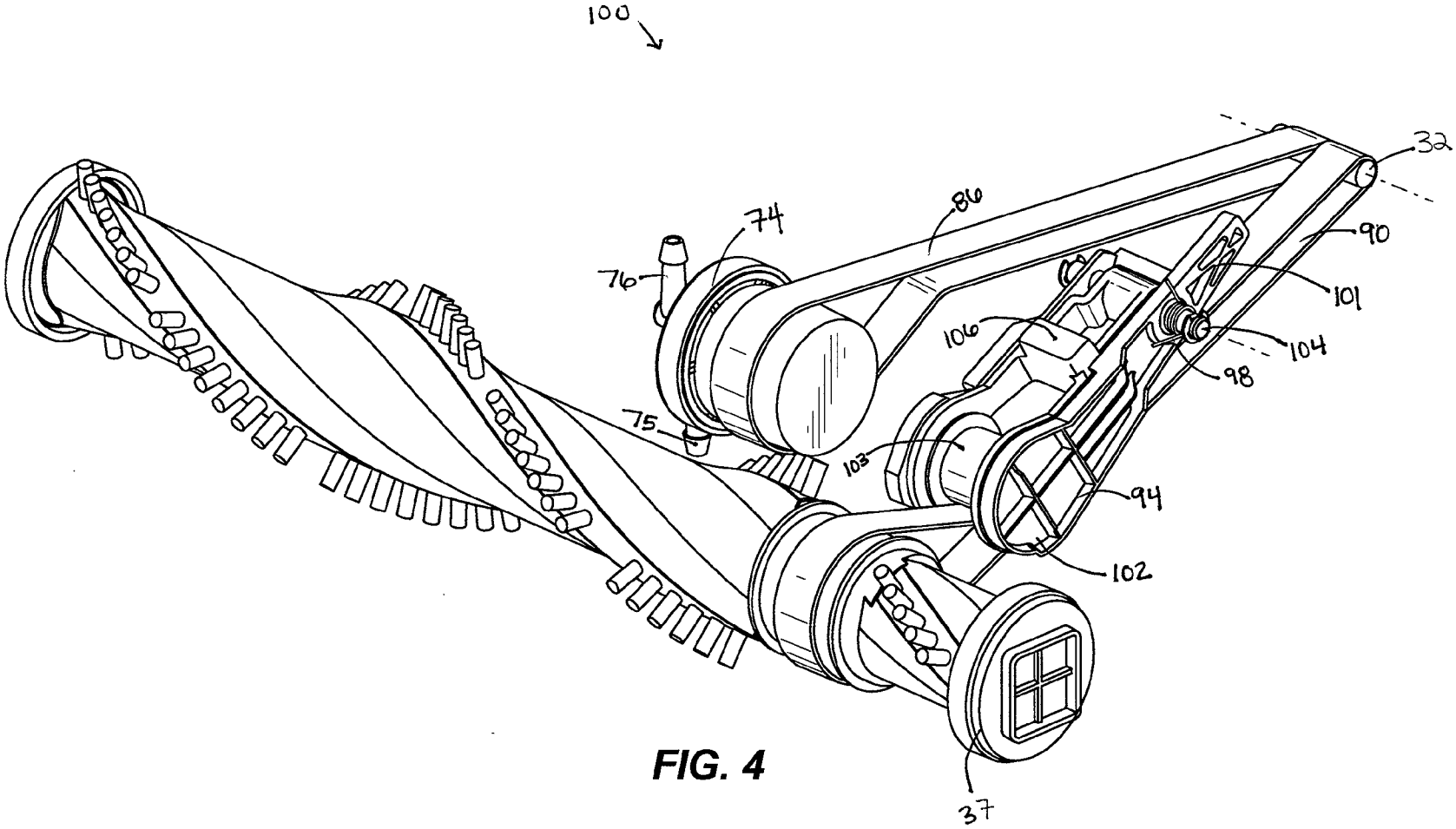
FIG. 4 is a perspective view of a drive mechanism for alternately driving a pump and an agitator of the extractor cleaning machine.

The accessory tool distribution subsystem includes the supply tank 70, a pump 74, the distribution nozzle 46 of the accessory tool 26, a trigger 78, the first hose 38 of the accessory tool 26, and conduits that connect the first hose 38 of the accessory tool 26 to the supply tank 70 and to the pump 74. As shown in FIG. 4, the pump 74 is positioned in the base 14 generally above the agitator 37. The pump 74 draws cleaning fluid from the supply tank assembly 70 through an inlet 75 and propels the cleaning fluid through an outlet 76 to the distribution nozzle 46 coupled to the accessory tool 26 to perform above-the-floor cleaning. In the illustrated embodiment, the pump 74 is driven by the motor 30. Referring back to FIG. 3, the supply tank 70 is also in fluid communication with the distribution nozzle 46 coupled to the accessory tool 26, via the first hose 38, to distribute cleaning fluid to the surface to be cleaned. In the illustrated embodiment, the trigger 78 is positioned on the cleaning head 42 of the accessory tool 26. In other embodiments, the trigger 78 may be positioned elsewhere on the accessory tool 26. The trigger 78 is actuatable to spray or distribute cleaning fluid through the distribution nozzle 46 of the accessory tool 26. The first hose 38 includes a valve coupled to the trigger 78 that may be selectively opened by actuating the trigger 78 to allow fluid to flow out of the distribution nozzle 46 of the accessory tool 42.

Referring back to FIG. 1, the motor 30 selectively drives the horizontal agitator 37 and the pump 74. The motor 30 is positioned in the base 14 generally behind the agitator 37 and the pump 74. The motor 30 drives the agitator 37 when the base 14 is used for cleaning a floor surface and drives the pump 74 when the accessory tool 26 is used for above-the-floor cleaning. In the illustrated embodiment, the motor 30 also drives the suction fan of the suction system.

As shown in FIG. 4, the extractor 10 also includes a drive mechanism 100 to selectively connect the motor 30 to one of the agitator 37 and the pump 74. In other embodiments, the drive mechanism 100 may be used to connect the motor 30 to other components of the extractor 10. The drive mechanism includes a first belt 86, a second belt 90, a belt tensioner 94, and a forcing member 98. The first belt, or pump belt, 86 extends between an output shaft 32 of the motor 30 and the pump 74 to selectively drive the pump 74. The second belt, or agitator belt, 90 extends between the output shaft 32 of the motor 30 and the agitator 37 to selectively drive the agitator 37. In the illustrated embodiment, the belts 86, 90 are endless belts formed of an elastomeric material. In other embodiments, the belts 86, 90 may be other types of drive members suitable to connect the pump 74 and the agitator 37 to the motor 30.

The belt tensioner 94 is an actuating device that includes a first end portion 101 and a second end portion 102 opposite the first end portion 101. The belt tensioner 94 also includes a roller 103 located at the second end portion 102. The roller 103 alternately engages the agitator belt 90 and the pump belt 86 to selectively tension the belts 86, 90. In the illustrated embodiment, the first end portion 101 is generally smaller than the second end portion 102 and includes straight surfaces that form a generally rectangular profile.

The belt tensioner 94 also includes a guide 106 positioned on an upper surface of the belt tensioner 94. The guide 106 is positioned between a pin 104 and the second portion 102 of the belt tensioner 94 and helps guide the pump belt 86 over the belt tensioner 94. In the illustrated embodiment, the guide 106 provides a smooth surface for the pump belt 86 to slide on while driving the pump 74. In other embodiments, the belt tensioner 94 may also include a second guide positioned on a lower surface of the belt tensioner 94 to help guide the agitator belt 90 under the belt tensioner 94. In yet other embodiments, the belt tensioner 94 may be positioned sufficiently far apart, such that the belts 86, 90 do not need the guide 106.

Figure 5:
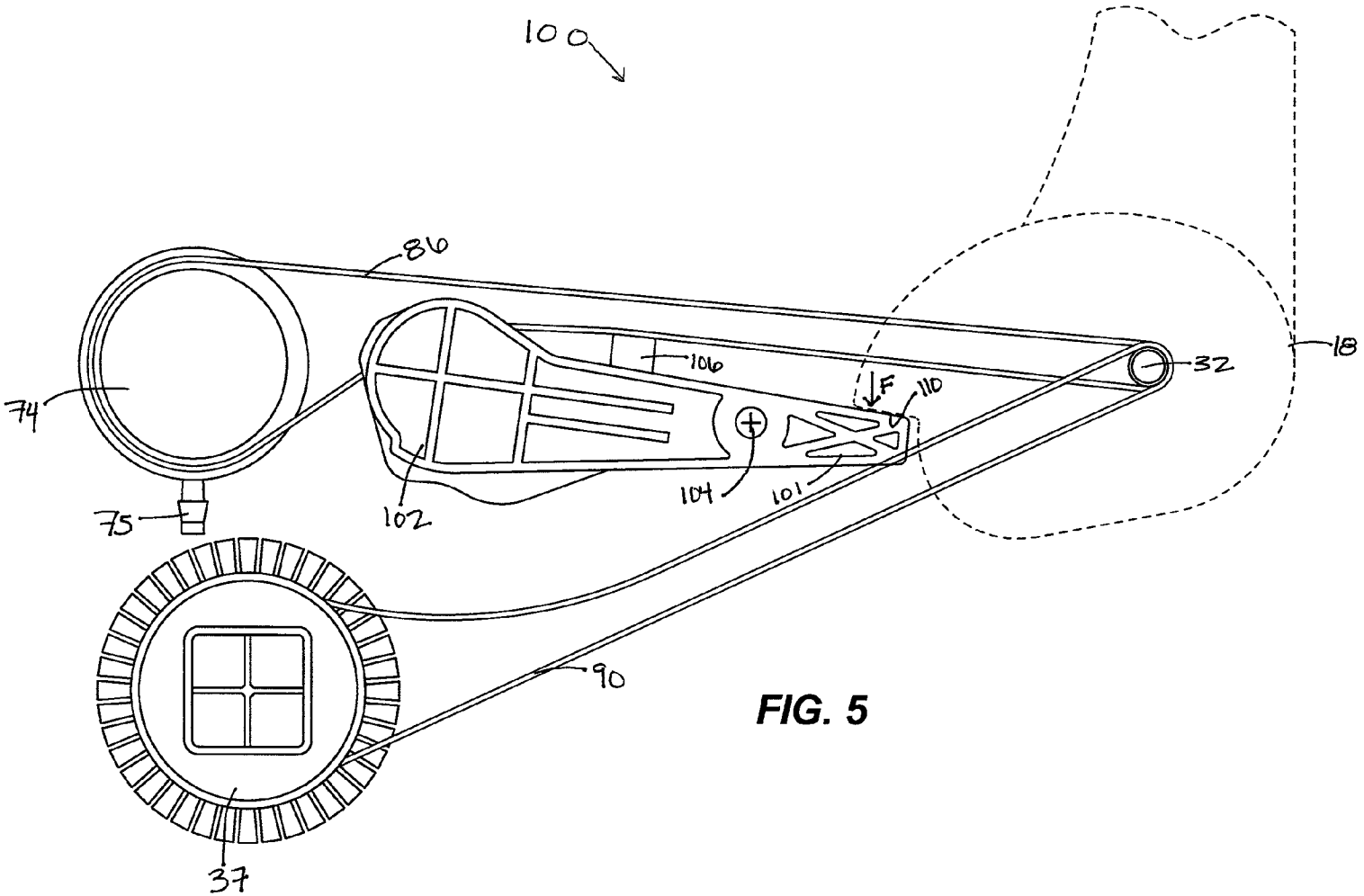
FIG. 5 illustrates the drive mechanism of FIG. 4 in a first position to drive the pump.
Figure 6:
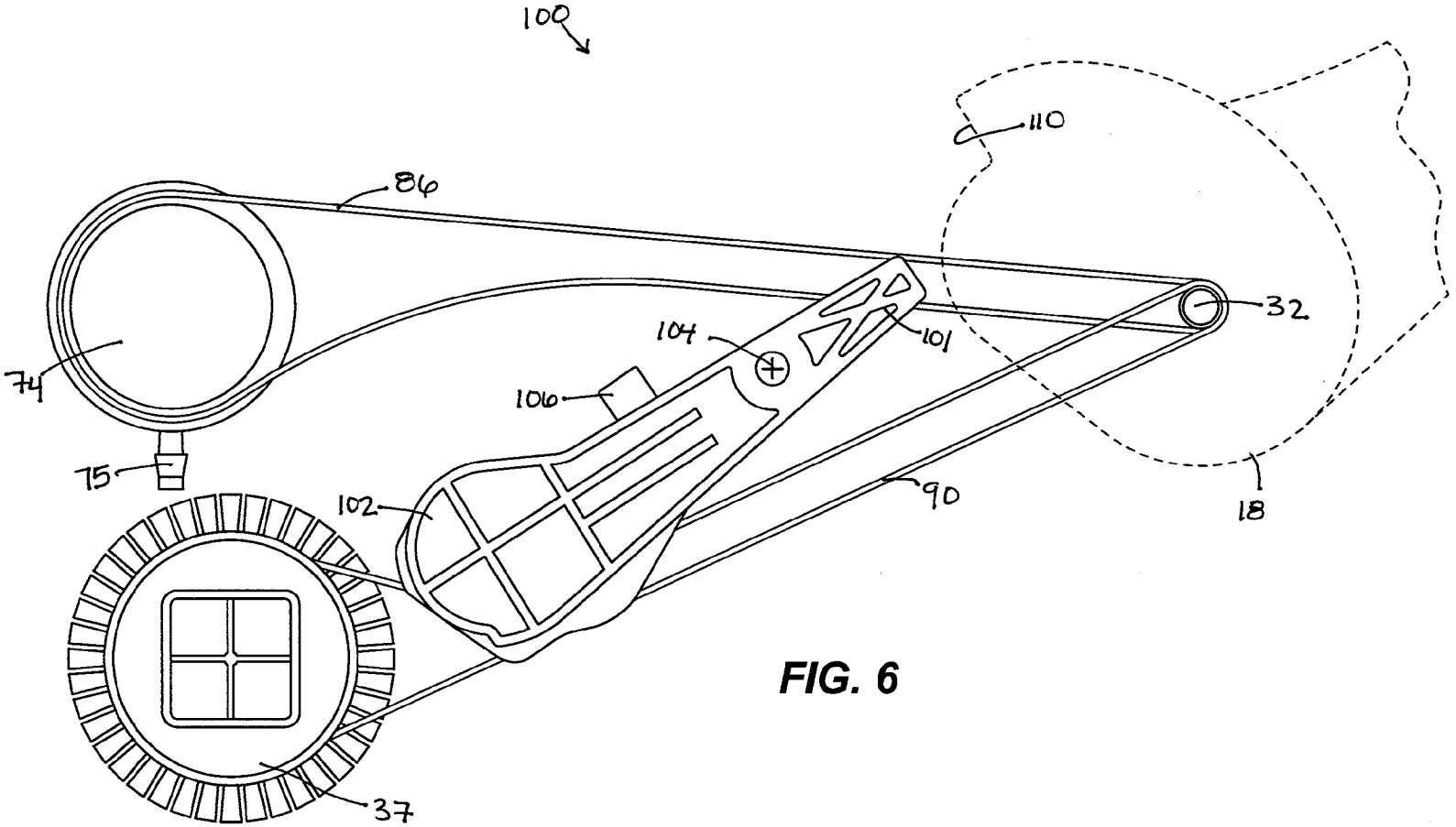
FIG. 6 illustrates the drive mechanism of FIG. 4 in a second position to drive the agitator.

As shown in FIGS. 5 and 6, the belt tensioner 94 pivots between a first position (FIG. 5) and a second position (FIG. 6). The belt tensioner 94 pivots about a pivot axis defined by the pin 104. In other embodiments, the pivot axis may be defined by other fastening components, such as a screw and the like. When in the first position (FIG. 5), the second portion 102 of the belt tensioner 94 is directed upward to tension the pump belt 86. When in the second position (FIG. 6), the second portion 102 of the belt tensioner 94 is directed downward to tension the agitator belt 90. The forcing member 98 is mounted about the pin 104. The forcing member 98 urges the belt tensioner 94 toward the second position. In the illustrated embodiment, the forcing member 98 is a torsion spring. The torsion spring 98 is configured such that the belt tensioner 94 is urged toward the second position. In other embodiments, other mechanisms may be used to urge the belt tensioner 94 toward the second position. In still other embodiments, the forcing member 98 may be configured to urge the belt tensioner 94 toward the first position.

As shown in FIG. 5, in the first position, the belt tensioner 94 tensions the pump belt 86. When the pump belt 86 is tensioned, the motor 30 operates the pump 74 and cleaning fluid is delivered to the distribution nozzle 46 located on the accessory tool 26 for above-the-floor cleaning. In this position, the belt tensioner 94 is spaced apart from the agitator belt 90 so that the agitator belt 90 is untensioned and the agitator 37 is not driven by the motor 30.

As shown in FIG. 6, in the second position, the belt tensioner 94 tensions the agitator belt 90. When the agitator belt 90 is tensioned, the motor 30 rotates the agitator 37 to improve cleaning of the surface beneath the base 14. In this position, the belt tensioner 94 is spaced apart from the pump belt 86 so that the pump belt 86 is untensioned and the pump 74 is not driven by the motor 30.

In the illustrated embodiment, the position of the belt tensioner 94 is controlled by the position of the handle 18. The handle 18 is mechanically coupled to the belt tensioner 94 and causes the belt tensioner 94 to move from the second position (FIG. 6) to the first position (FIG. 5). In the illustrated embodiment, the handle 18 includes a shoulder 110 that engages an upper surface of the first end portion 101 of the belt tensioner 94 when the handle 18 is in the upright position. When the shoulder 110 of the handle 18 engages the first end portion 101 of the belt tensioner 94, the handle 18 applies a force F on the first end portion 101 of the belt tensioner 94. The force F overcomes the urging force from the forcing member 98 and moves the belt tensioner 94 to the first position (FIG. 5). When the handle 18 is in the inclined position (FIG. 2), the shoulder 110 of the handle 18 moves away from the belt tensioner 94. The belt tensioner 94 is then urged to the second position (FIG. 6) by the forcing member 98. In other embodiments, the handle 18 may be mechanically coupled to the belt tensioner 94 using other mechanisms, such as linkage or gears.

In other embodiments, the position of belt tensioner 94 may be controlled by another suitable actuator instead of by the position of the handle 18. For example, the position of the belt tensioner 94 may be controlled by a switch or lever located on the base 14 of the extractor 10. In such embodiments, the switch or lever may be actuated by a user (independently of the handle 18) to move the belt tensioner 94 between the first and second positions. The switch or lever may move the belt tensioner 94 via a mechanical or electrical mechanism.

In other embodiments, the belt tensioner 94 does not include the forcing member 98. Rather, the extractor 10 includes a first actuator that moves the belt tensioner 94 toward the first position (FIG. 5), and includes a second actuator that moves the belt tensioner 94 toward the second position (FIG. 6). For example, in such embodiments, the handle 18 may include a first shoulder and a second shoulder. When the handle 18 is in the upright position (FIG. 1), the first shoulder may engage the belt tensioner 94 to move the belt tensioner 94 to the second position (FIG. 6). When the handle 18 is in the inclined position (FIG. 2), the second shoulder may engage the belt tensioner 94 to move the belt tensioner 94 to the first position (FIG. 5).

In operation, a user cleans a floor surface using the extractor 10. The user inclines the handle 18 and rolls the extractor 10 across the floor surface to be cleaned. The user actuates the trigger 68 to distribute cleaning fluid onto the surface through the distribution nozzle 36 coupled to the base 14. Due to the inclined position of the handle 18, the belt tensioner 94 is in the second position (FIG. 6) so that the motor 30 rotates the agitator 37 to scrub or beat the surface. The motor 30 also drives the suction fan to generate a vacuum force in the nozzles 35, 50. The suction nozzle 35 coupled to the base 14 draws any cleaning fluid and dirt from the surface to the recovery tank 58.

When the user wants to perform above-the-floor cleaning, the user places the handle 18 in the vertical, upright position and connects the accessory tool 26 to the first connection port 52 and to the second connection port 54 on the base 14. Due to the upright position of the handle 18, the belt tensioner 94 is in the first position (FIG. 5) so that the motor 30 drives the pump 74 to deliver cleaning fluid to the cleaning head 42. The user performs above-the-floor cleaning using the cleaning head 42 attached to the accessory tool 26. Cleaning fluid travels through the distribution hose 38 and is dispensed through the distribution nozzle 46 coupled to the accessory tool 26. Fluid and dirt are drawn into the recovery tank 58 through the suction nozzle 50 coupled to the accessory tool 26 and the suction hose 40. When the user finishes conducting above-the-floor cleaning, he/she disconnects the accessory tool 26 from the first connection port 52 and from the second connection port 54 and places the accessory tool 26 in its storage position.

Figure 7:
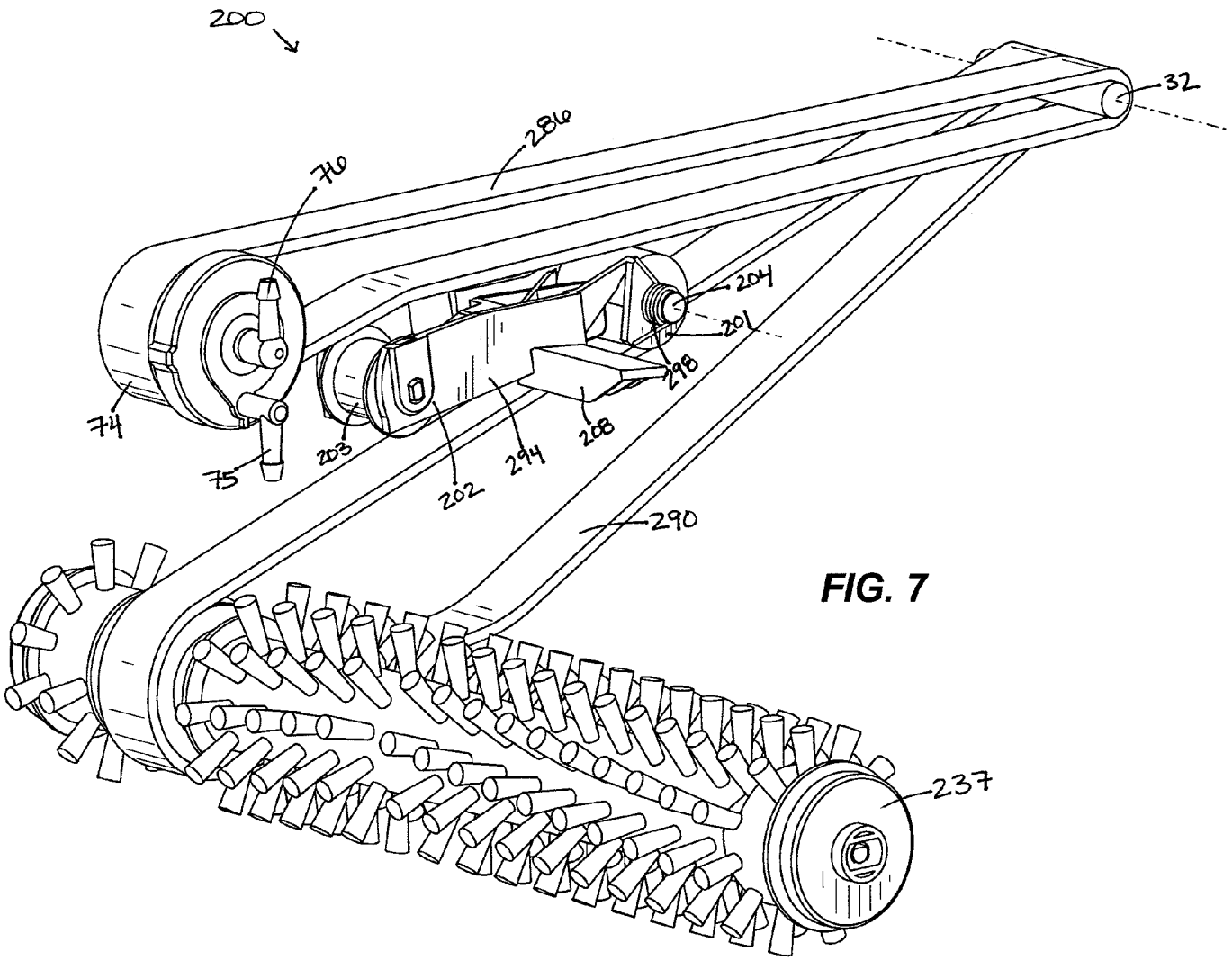
FIG. 7 is a perspective view of a second drive mechanism for alternately driving the pump and the agitator of the extractor cleaning machine.
Figure 8:
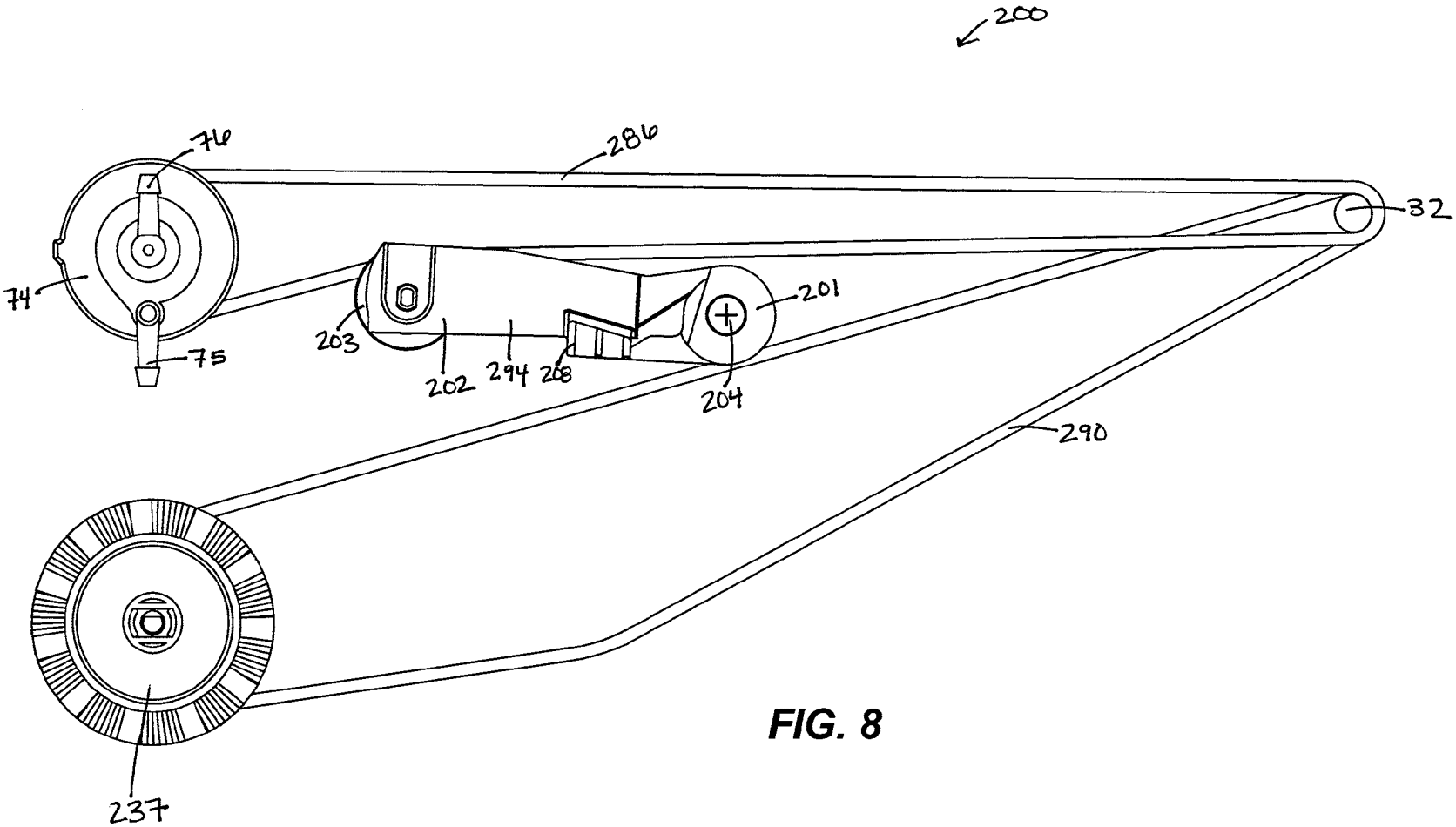
FIG. 8 illustrates the drive mechanism of FIG. 7 in a first position to drive the pump.
Figure 9:
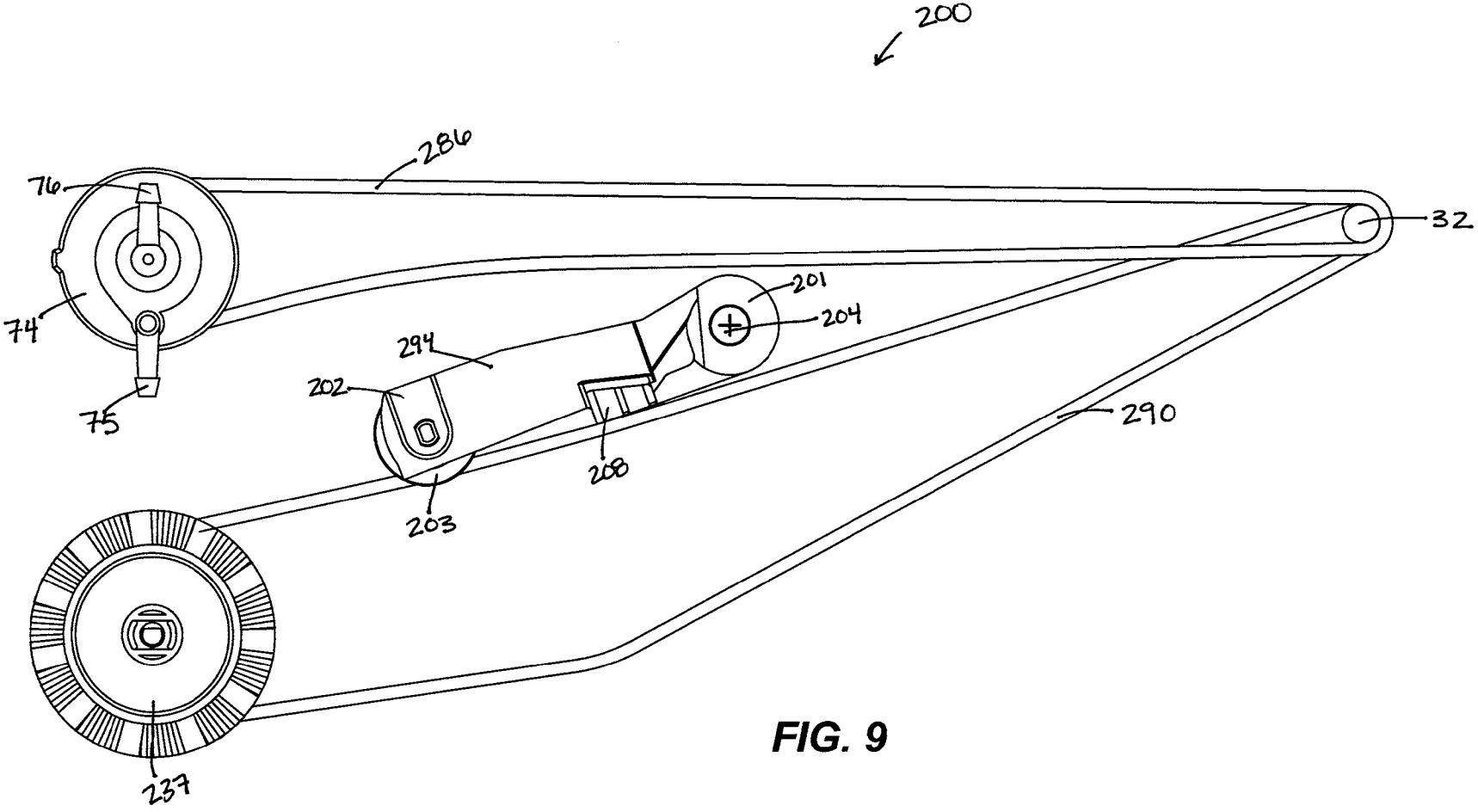
FIG. 9 illustrates the drive mechanism of FIG. 7 in a second position to drive the agitator.

FIGS. 7-9 illustrate another embodiment of a drive mechanism 200 to selectively connect the motor 30 to one of an agitator 237 and the pump 74. The drive mechanism 200 includes similar components as the drive mechanism 100 shown in FIGS. 4-6, and like parts have been given like reference numbers, plus 200. The drive mechanism 200 includes a first belt 286, a second belt 290, a belt tensioner 294, and a forcing member 298. The first belt, or pump belt, 286 extends between an output shaft 32 of the motor 30 and the pump 74 to selectively drive the pump 74. The second belt, or agitator belt, 290 extends between the output shaft 32 of the motor 30 to the agitator 237 to selectively drive the agitator 237. Although the agitator 237 shown in FIGS. 1-7 appears different than the agitator 37 shown in FIGS. 1-6, both agitators 37, 237 are horizontal brush rolls and function in substantially the same manner. In the illustrated embodiment, the belts 286, 290 are endless belts formed of an elastomeric material.

The belt tensioner 294 includes a first end portion 201 and a second end portion 202 opposite the first end portion 201. The belt tensioner 294 also includes a roller 203 located at the second end portion 202. The roller 203 alternately engages the agitator belt 290 and the pump belt 286 to selectively tension the belts 286, 290. In the illustrated embodiment, the first end portion 201 and the second end portion 202 are approximately the same size and form generally round profiles.

As shown in FIGS. 8 and 9, the belt tensioner 294 pivots between a first position (FIG. 8) and a second position (FIG. 9). The belt tensioner 294 pivots about a pivot axis defined by a pin 204. When in the first position (FIG. 8), the second portion 202 of the belt tensioner 294 is directed upward to tension the pump belt 286. When in the second position (FIG. 9), the second portion of the belt tensioner 294 is directed downward to tension the agitator belt 290. The forcing member 298 is mounted about the pin 204 and urges the belt tensioner 294 to the second position.

The belt tensioner 294 also includes a flange 208. The flange 208 engages the handle 18 of the extractor 10 to move the belt tensioner 294 from the second position (FIG. 9) to the first position (FIG. 8). The force of the handle 18 on the flange 208 overcomes the urging force from the forcing member 298 and moves the belt tensioner 294 to the first position (FIG. 8). When the handle 18 is in the inclined position (FIG. 2), the handle 18 does not engage the belt tensioner 294. The belt tensioner 294 is then urged to the second position (FIG. 9) by the forcing member 298.

As shown in FIG. 8, in the first position, the belt tensioner 294 tensions the pump belt 286. When the pump belt 286 is tensioned, the motor 30 operates the pump 74 and cleaning fluid is delivered to the distribution nozzle 46 located on the accessory tool 26 for above-the-floor cleaning. In this position, the belt tensioner 294 is spaced apart from the agitator belt 290 so that the agitator belt 290 is untensioned and the agitator 237 is not driven by the motor 30.

As shown in FIG. 9, in the second position, the belt tensioner 294 tensions the agitator belt 290. When the agitator belt 290 is tensioned, the motor 30 rotates the agitator 237 to improve cleaning of the surface beneath the base 14. In this position, the belt tensioner 294 is spaced apart from the pump belt 286 so that the pump belt 286 is untensioned and the pump 74 is not driven by the motor 30.

Figure 10:
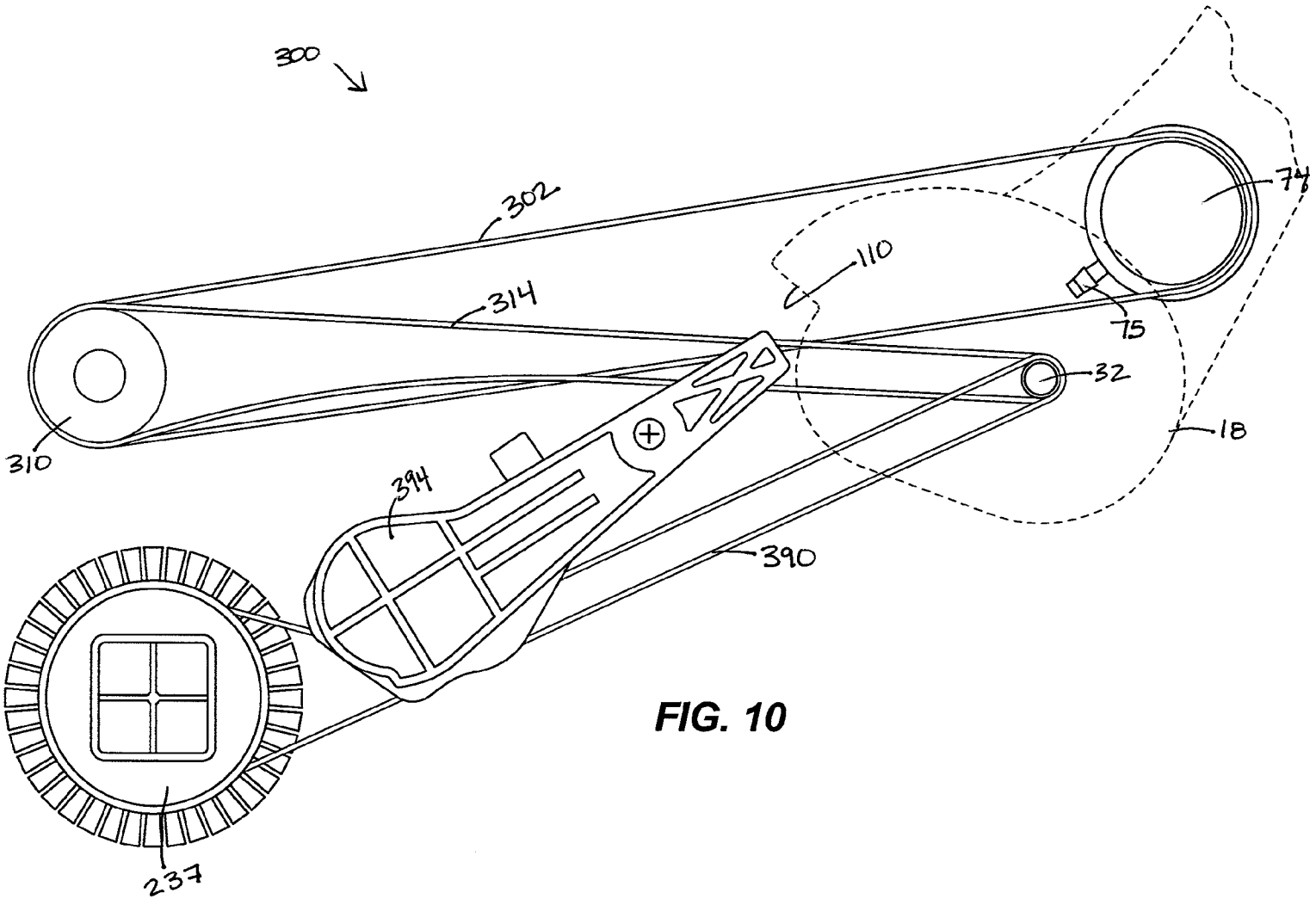
FIG. 10 illustrates a third drive mechanism for alternately driving the pump and the agitator of the extractor cleaning machine.

FIG. 10 illustrates another embodiment of a drive mechanism 300 to selectively connect the motor 30 to one of the agitator 237 and the pump 74. The drive mechanism 300 includes similar components as the drive mechanism 100 shown in FIGS. 7-9, and like parts have been given like reference numbers, plus 300. The drive mechanism 300 includes a first pump belt 302, a second pump belt 314, an agitator belt 390, a belt tensioner 394, and a forcing member 98. The first pump belt 302 connects the pump 74 to an idler pulley 310. The second pump belt 314 connects the idler pulley 310 to the output shaft 32 of the motor 30. The agitator belt 390 connects the agitator 237 to the output shaft 32 of the motor 30. In the illustrated embodiment, the pump 74 is positioned generally behind the motor 30 and the motor 30 is positioned generally between the agitator 237 and the pump 74, and the idler pulley 310 is positioned generally above the agitator 237. The idler pulley 310 rotates about an axis defined at the center of the idler pulley 310. Including the idler pulley 310 and the second pump belt 314 in the drive mechanism 300 allows the pump 74 to be positioned behind the agitator 237, or elsewhere on the extractor 10, rather than above the agitator 237.

The belt tensioner 394 is pivotable between a first position and a second position in a manner similar to the belt tensioner 94 described with respect to FIGS. 5 and 6. The first pump belt 302 remains tensioned regardless of the position of the belt tensioner 394. In the first position, the belt tensioner 394 tensions the second pump belt 314. When the second belt 314 is tensioned by the belt tensioner 394, the idler pulley 310 rotates in response to rotation of the motor 30. Rotation of the idler pulley 310 drives the pump 74 through the tensioned first pump belt 302. In the first position, the agitator belt 390 is untensioned and the agitator 237 is not driven by the motor 30. In the second position, as shown in FIG. 10, the belt tensioner 394 tensions the agitator belt 390. When the agitator belt 390 is tensioned by the belt tensioner 394, the motor 30 drives the agitator 237. In the second position, the second pump belt 314 is untensioned and the pump 74 is not driven by the motor 30. Other operations of the drive mechanism 300 to drive the pump 74 and the agitator 237 are substantially the same as the drive mechanism 100 discussed above with reference to FIGS. 4-5.

Thus, the invention provides, among other things, an extractor including a drive mechanism coupled to a motor to alternately drive one of an agitator and a pump. Various features and advantages of the invention are set forth in the following claims.

What is claimed is:

1. An extractor cleaning machine comprising:

a base movable along a surface to be cleaned, the base including an agitator;

a distribution nozzle;

a suction nozzle;

a suction source in fluid communication with the suction nozzle, the suction source operable to draw fluid and dirt from the surface through the suction nozzle;

a recovery tank supported by the base, the recovery tank in fluid communication with the suction source to receive and store the fluid and dirt drawn through the suction nozzle;

a supply tank supported by the base, the supply tank in fluid communication with the distribution nozzle to supply cleaning fluid to the distribution nozzle;

a pump in fluid communication with the supply tank and the distribution nozzle to deliver fluid from the supply tank to the distribution nozzle;

a motor operable to drive the agitator and the pump, the motor including an output shaft; and a drive mechanism coupled to the output shaft of the motor, the agitator, and the pump, the drive mechanism operable to selectively connect the agitator and the pump to the motor to alternately drive the agitator and the pump.

2. The extractor cleaning machine of claim 1, further comprising an accessory tool coupled to the base for above-the-floor cleaning, wherein the accessory tool includes the distribution nozzle.

3. The extractor cleaning machine of claim 2, wherein the distribution nozzle is a first distribution nozzle, and wherein the base includes a second distribution nozzle in fluid communication with the supply tank.

4. The extractor cleaning machine of claim 2, wherein the accessory tool also includes the suction nozzle.

5. The extractor cleaning machine of claim 1, wherein the drive mechanism includes a first belt extending between the pump and the output shaft of the motor, and a second belt extending between the agitator and the output shaft of the motor.

6. The extractor cleaning machine of claim 5, wherein the drive mechanism also includes a belt tensioner, and wherein the belt tensioner is movable relative to the first belt and the second belt to selectively tension the first and second belts.

7. The extractor cleaning machine of claim 6, wherein the belt tensioner is pivotable between a first position, in which the belt tensioner tensions the first belt to drive the pump, and a second position, in which the belt tensioner tensions the second belt to drive the agitator.

8. The extractor cleaning machine of claim 7, further comprising a handle pivotally coupled to the base, wherein the handle is pivotable relative to the base between a substantially upright position and an inclined operating position.

9. The extractor cleaning machine of claim 8, wherein the belt tensioner is in the first position when the handle is in the substantially upright position, and wherein the belt tensioner is in the second position when the handle is in the inclined operating position.

10. The extractor cleaning machine of claim 9, wherein a portion of the handle engages the belt tensioner when the handle is in the substantially upright position to pivot the belt tensioner to the first position.

11. The extractor cleaning machine of claim 10, wherein the drive mechanism further includes a forcing member coupled to the belt tensioner, and wherein the forcing member urges the belt tensioner toward the second position.

12. The extractor cleaning machine of claim 1, wherein the pump, the motor, and the drive mechanism are positioned within the base.

13. The extractor cleaning machine of claim 1, wherein the motor is also coupled to the suction source to drive the suction source.

14. An extractor cleaning machine comprising:

a base movable along a surface to be cleaned, the base including a suction nozzle;

an accessory tool coupled to the base for above-the-floor cleaning, the accessory tool including a distribution nozzle;

a handle pivotally coupled to the base for movement between a substantially upright position and an inclined operating position;

a suction source in fluid communication with the suction nozzle, the suction source operable to draw fluid and dirt from the surface through the suction nozzle;

a recovery tank supported by the base, the recovery tank in fluid communication with the suction source to receive and store the fluid and dirt drawn through the suction nozzle;

a supply tank supported by the base, the supply tank in fluid communication with the distribution nozzle to supply cleaning fluid to the distribution nozzle;

a pump in fluid communication with the supply tank and the distribution nozzle to deliver fluid from the supply tank to the distribution nozzle;

a motor operable to drive the pump, the motor including an output shaft;

a belt coupled to the output shaft of the motor and the pump to selectively drive the pump; and a belt tensioner movable relative to the belt, the belt tensioner engaging the belt to tension the belt when the handle is in the substantially upright position, and the belt tensioner disengaging the belt to untension the belt when the handle is in the inclined operating position.

15. The extractor cleaning machine of claim 14, wherein the suction nozzle is a first suction nozzle, and wherein the accessory tool includes a second suction nozzle in fluid communication with the suction source.

16. The extractor cleaning machine of claim 14, wherein the distribution nozzle is a first distribution nozzle, and wherein the base includes a second distribution nozzle in fluid communication with the supply tank.

17. The extractor cleaning machine of claim 16, wherein the base further includes an agitator.

18. The extractor cleaning machine of claim 14, wherein the belt tensioner is pivotable between a first position, in which the belt tensioner engages the belt, and a second position, in which the belt tensioner disengages the belt.

19. The extractor cleaning machine of claim 18, wherein a portion of the handle engages the belt tensioner when the handle is in the substantially upright position to pivot the belt tensioner to the first position.

20. The extractor cleaning machine of claim 19, further comprising a forcing member coupled to the belt tensioner, wherein the forcing member urges the belt tensioner toward the second position.

21. The extractor cleaning machine of claim 20, wherein the portion of the handle is spaced apart from the belt tensioner when the handle is in the inclined operating position to allow movement of the belt tensioner to the second position.

* * * * *